US005123860A

United States Patent [19]

Kamei et al.

[11] Patent Number: 5,123,860

[45] Date of Patent: Jun. 23, 1992

[54] CONNECTOR BACKSHELL STRUCTURE

[75] Inventors: Takeo Kamei; Katsuyuki Sekine, both of Iruma, Japan

[73] Assignee: Yokogawa Aviation Company, Ltd., Iruma, Japan

[21] Appl. No.: 770,551

[22] Filed: Oct. 3, 1991

[30] Foreign Application Priority Data

Mar. 8, 1991 [JP] Japan ..... 3-68810

[51] Int. Cl.[5] ..... H01R 13/648; H01R 13/59

[52] U.S. Cl. ..... 439/462; 439/610

[58] Field of Search ..... 439/98, 99, 461, 462, 439/610

[56] References Cited

U.S. PATENT DOCUMENTS 4,854,891 8/1989 Kamei et al. ..... 439/462

FOREIGN PATENT DOCUMENTS 71084 3/1989 Japan ..... 439/610

*Primary Examiner*—Gary F. Paumen

*Attorney, Agent, or Firm*—Moonray Kojima

[57] ABSTRACT

A grounding connector for a shielded cable comprising a backshell, a cap nut, and a ring therebetween, wherein the ring is of a novel design having a single slit and at least three protrusions extending axially toward the cap nut, whereby previously used tube, stepped ring, and spring washers are all eliminated. The invention is thus substantially simplified from the prior art, has enhanced EMI prevention properties, greatly reduced costs, and greatly increased reliability, and improved performance.

5 Claims, 4 Drawing Sheets

CONNECTOR BACKSHELL STRUCTURE

BACKGROUND OF THE INVENTION

1. Field of Invention

This invention relates to a grounding connector; and more particularly, to an improved and simplified grounding connector.

2. Description of the Prior Art

FIGS. 1 and 2 depict a conventional grounding connector, such as disclosed, for example, in U.S. Pat. No. 4,854,891. In FIGS. 1 and 2, a grounding shield 1*a* covers the outer periphery of a cable 1 which is passed through a connector backshell 2 (also called "shell") formed with an inner tapered portion 2*a*. Shell 2 is joined to a connector member 3 to which cable 1 is connected. A wedge shaped ring 4, made for example of aluminum, has two slits. Shield 1*a* is bent outwardly and in a connected condition closely contacts the tapered portion 2*a* of shell 2. Ring 4 acts to press the shield against shell 2. A spring washer 5 elastically presses ring 4 against tapered portion 2*a* through a stepped ring 6 having a stepped portion 6*a*.

Stepped ring 6 is loosely fitted to cable 1 so that an extended part of shield 1*a*, interposed between ring 4 and tapered portion 2*a*, is held between ring bottom 4*a* (see FIG. 2) and stepped ring 6.

A tube 7 comprises a metal member formed with a slit. A cap nut 8 comprises a collar 8*a* for press fitting ring 4 to tapered portion 2*a* through washer 5 and stepped ring 6; and a stepped portion 8*b* on its inner peripheral portion.

In order to ground shield 1*a*, the elements are assembled in the following manner.

(a) First, a cable sheath, not shown, of cable 1 which confronts tapered portion 2*a* is peeled off so that shield 1*a* is exposed.

(b) Next, a metal knit mesh 9 is wound on a part of the exposed shield 1*a*, and a tube 7 is fixed onto this knit mesh 9.

(c) Then, ring 4 is slidably fitted to tube 7, and shield 1*a* is brought into contact between tapered part 2*a* and tube 7.

(d) Washer 5 is then attached to stepped portion 6*a* and is moved in the arrowed direction P of FIG. 2 by screwing nut 8 onto the screw threads of the outer periphery of shell 2. Consequently, ring 4 is pressed against tapered part 2*a* through stepped ring 6 with the elastic force of washer 5.

(e) The tightness of the screw fitting is regulated by the stepped portion 8*b* of nut 8 fitting against the end part of shell 2.

There arises, however, with the conventional device, the following problems. The attached shield 1*a* may deform or even collapse when subjected to vibration, temperature differences, etc and the grounding part of the shield may slacken. Slackening reduces the EMI (Electrical Magnetic Interference) protection effect. Also, nut 8 may become loosened due to the slackening of the grounding part so that mechanical strength decreases, and the device may thus become dysfunctional.

SUMMARY OF THE INVNETION

An object of the invention is to overcome the aforementioned and other deficiencies and disadvantages of the prior art.

Another object is to provide a grounding connector which improves the EMI effect, has electrical and mechanical durability, and has a simpler structure.

A further object is to provide a grounding connector which employs an improved wedge shaped ring and eliminates certain other elements previously used in the prior art.

The foregoing and other objects of the invention are attained in a grounding connector comprising a cable including a shield on its outer periphery; a connector backshell, through which the cable is passed, formed with a tapered protion on its inner periphery; a connector, havings its back portion joined to the connector backshell, to which the cable is connected; a wedge shaped ring for bringing the shield into contact with the tapered protion of the backshell, the shield being bent outwardly to be exposed; and a cap nut for press fitting the ring to the tapered portion of the backshell.

Advantageously, the ring is made of a spring material with a slit so as to interpose the shield between the shell and the ring to ground the shield. The ring has at least three circumferentially spaced protrusions formed unitarily with the ring and which extend toward and engage the cap nut. The cap nut comprises a collar for receiving the protrusions when the cap nut is pressed thereagainst, and a stepped portion which contacts the end of the back shell.

Advantageously, with the invention, even though the shield may slacken due to vibration, temperature differences, etc, the slack of the ring towards the nut is prevented by an outward expanding force of the ring. Thus, looseness between the cable and the grounding connector is prevented. Also, advantageously, the shell and the nut have the stepped contact structure. Thus, even when slackness is produced in the cable and shield, no looseness is caused to the nut. Thus, with the invention, elimination or reducing of the EMI effect is substantially improved and electrical and mechanical durability is improved. Also, advantageously, the embodiment may comprise a knit mesh used in combination with the novel ring .

DETAILED DESCRIPTION OF THE PREFERRED EMBODIMENTS

Figure 1:
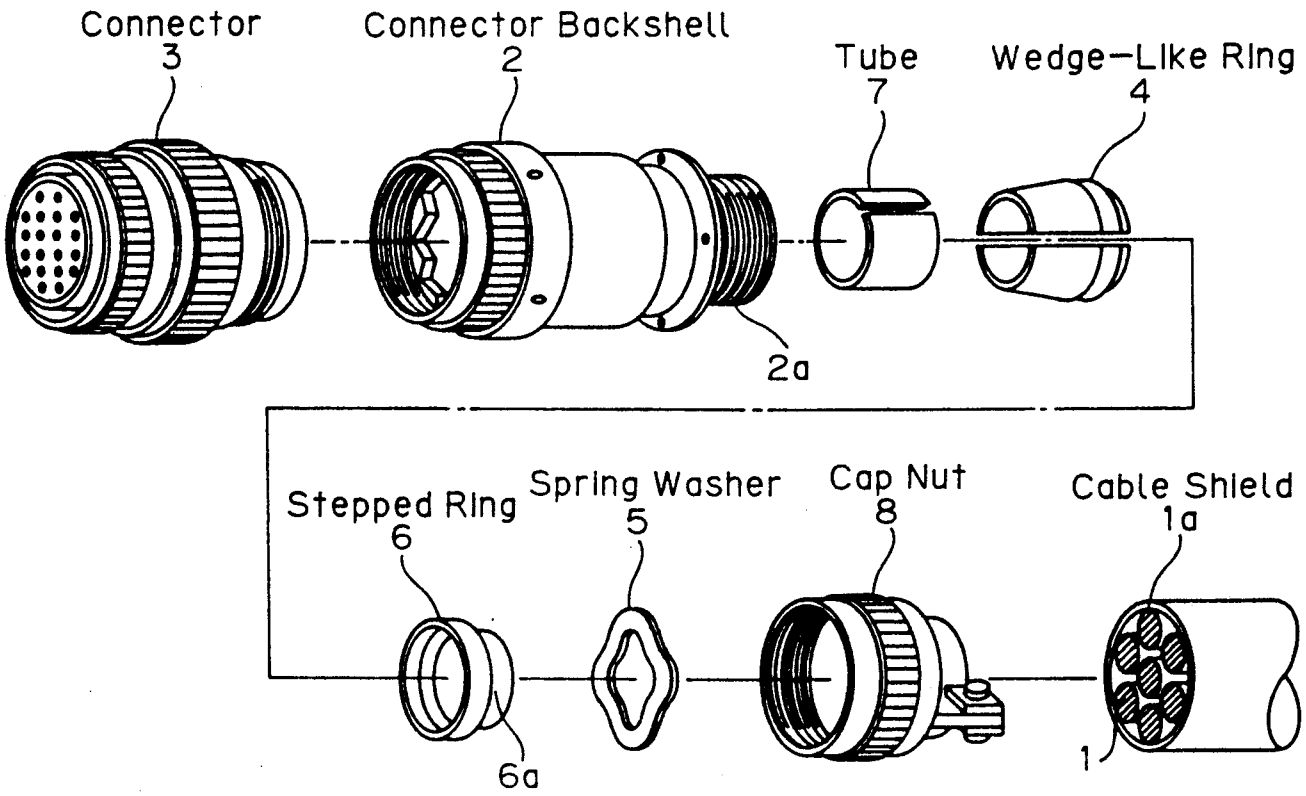
Fig.1 (Prior Art)
FIG. 1 is an exploded view of a conventional connector.
Figure 2:
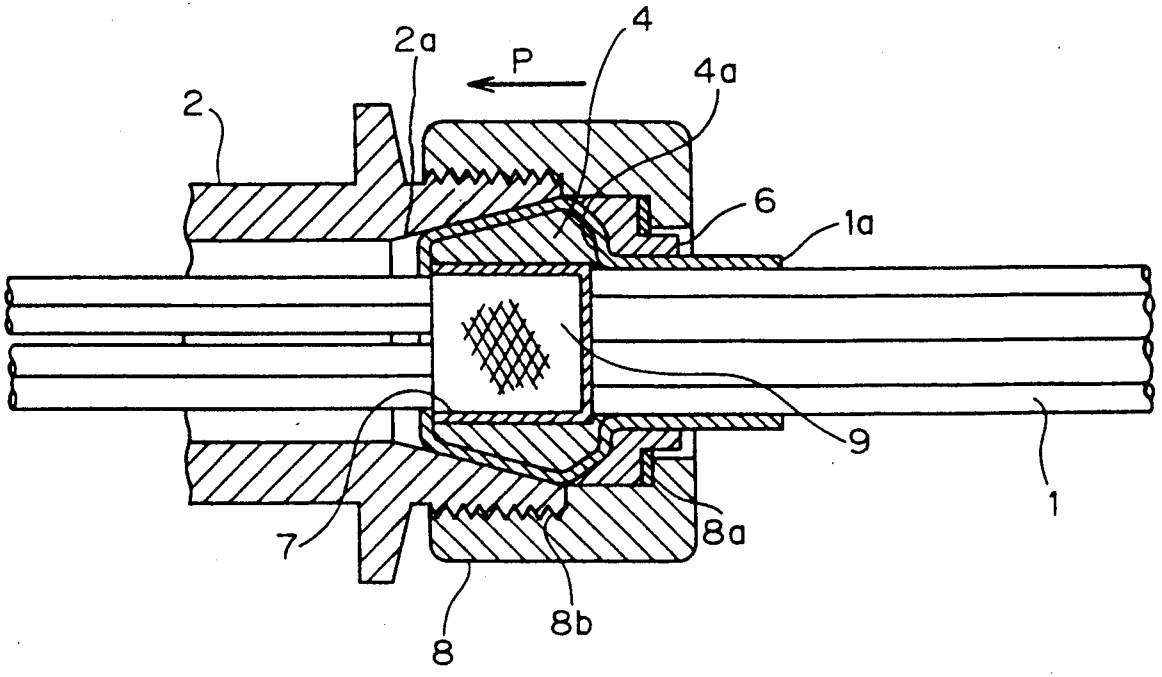
Fig.2 (Prior Art)
FIG. 2 is a side sectional view of the device of FIG. 1
Figure 3:
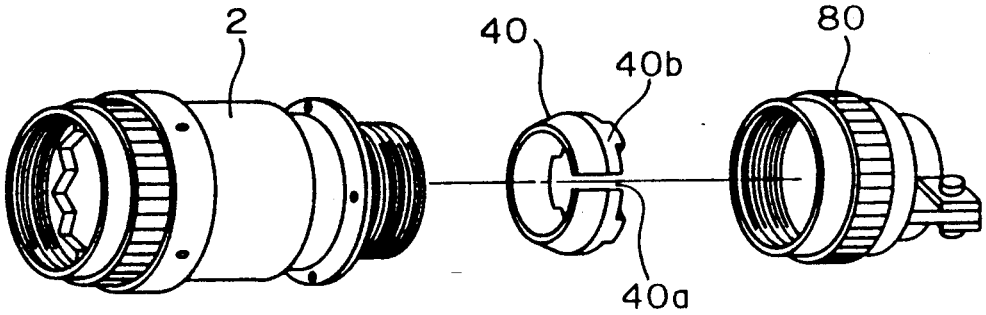
FIG. 3 is a perspective view depicting an illustrative embodiment of the invention.
Figure 4:
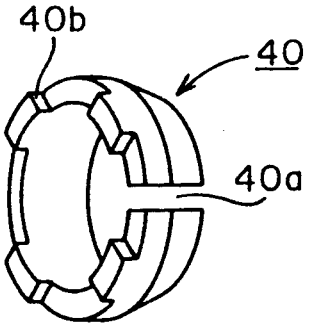
FIG. 4 is a perspective view of the wedge shaped ring of the invention.
Figure 5:
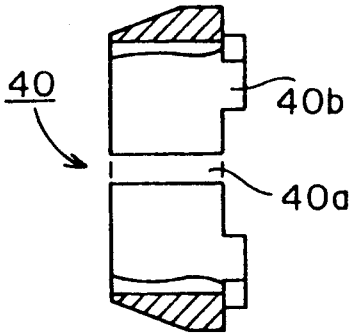
FIG. 5 is a sectional view of the ring of FIG. 4.

The components depicted in FIGS. 3–6 which are similar to those shown in FIGS. 1,2 are delineated with the same numerals and description thereof is omitted hereat for sake of convenience.

A wedge shaped ring 40 has a spring property and is interposed between shield 1*a* and shell 2, and acts to ground shield 1*a*. Thus, ring 40 acts to enhance the EMI effect elimination or reduction. Ring 40 has resilient, such as a spring, properties and is formed with a slit 40*a* in its axial direction. It has at least three or more circumferentially spaced protrusions formed unitarily therewith (with four protrusions being shown in FIG. 4 to provide uniform force when fastened with nut 80) and extending toward the nut 80. Ring 40 has a wedge shaped configuration to press the shield 1*a* against the tapered inner periphery of shell 2. Nut 80 has a collar 80*a* for receiving protrusions 40*b*, and a stepped portion 80*b* to contact the end part of shell 2.

Ring 40 is made, for example, of a spring steel, and is thus capable of press fitting shield 1*a* closely to tapered part 2*a* when pressed by nut 80. Ring 40 also serves to reduce contact resistance.

The connector assembly is fabricated in the following manner.

(a) A metal knit mesh 9 is partly wound about exposed shield 1*a*.

(b) Then, ring 40 is slidably fitted and shield 1*a* is made to contact tapered part 2*a*. Shield 1*a* deforms, as illustrated in FIG. 6, around protrusions 40*b*.

Figure 6:
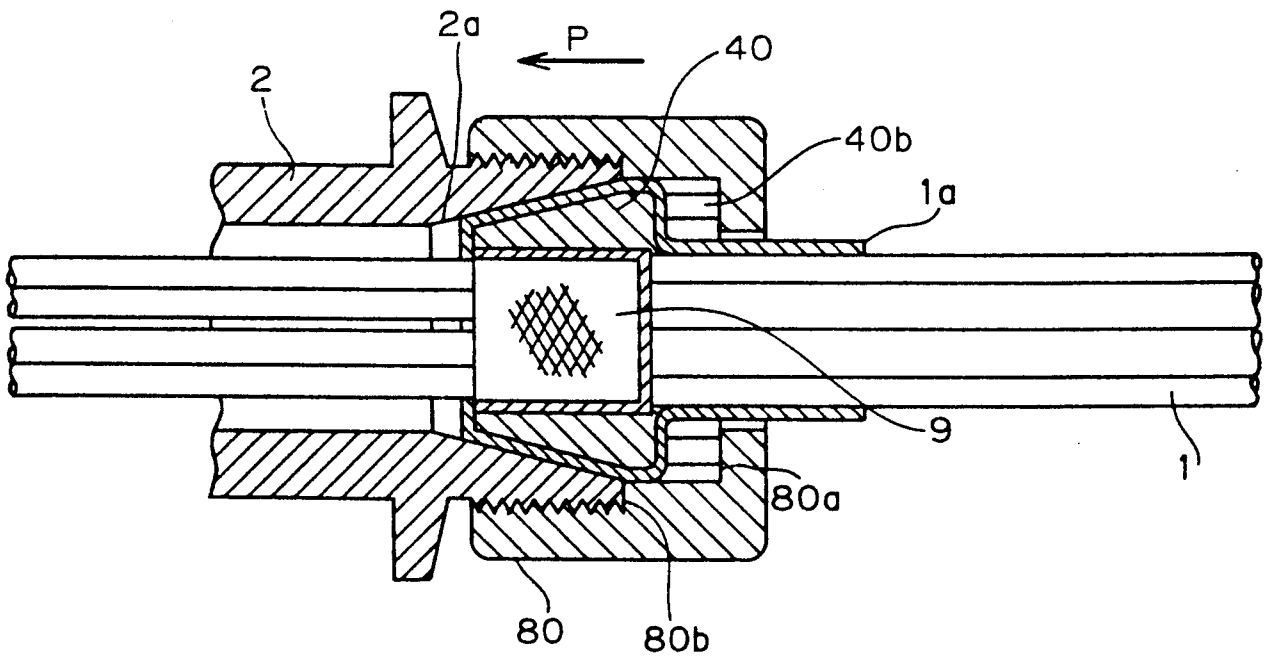
FIG. 6 is a sectional view of the connector assembly of the invention.

(c) Nut 80 thrusts ring 40 in the arrowed direction P of FIG. 6 through protrusions 40*b* by screw fastening collar 80*a* to a screw thread of the outer periphery of shell 2. Accordingly, an inclined part of ring 40 is pushed against the tapered portion 2*a* by the spring force of ring 40 with shield 1*a* interposed therebetween.

(d) Screw fastening is regulated by stepped portion 80*b* of of nut 80 contacting the end part of shell 2. Shell 2 and nut 8 contact each other. Thus, even when any interactive movement is caused by such influences as vibrations, temperature changes, etc, there is no slack of the nut that does not disappear into the shield and cable.

(e) Thus, in ring 40, the spring force acts on the tapered part 2*a*. Even if conformable deformations or collapses occur in cable 1 and shield 1*a* because of vibration, changes of temperature, etc, the contact force of the portion interposed between the tapered part 2*a* and ring 40 is kept constant. Any slack in the ring 40 towards the nut 80 is prevented by the protrusions 40*b*.

The invention is not strictly limited to the above discussed structure. For example, the slit may be positioned as desired. Also, the configuration of the ring 40 may be as desired provided that there is a spring force generated thereby.

The invention has many advantages. For example, the above embodiment having the described nut and ring structure enables maintenance of constant force between the shell 2 and ring 40. By keeping a constant force, slack between the shield and shell is prevented, and grounding is more completely and constantly effected. Thus, improvement in preventing the EMI effect is attained, as is improvement in electrical and mechanical durability.

The invention uses a stepped structure which insures contact between the shell and the nut so that even when collapse or conformable deformation of the shield are produced, the nut does not slacken.

Finally, and just as importantly, the invention reduces the number of parts needed in a grounding connector. The ring 40 has a novel protrusion structure which governs the distance and contact between the ring and the nut, and has only a single slit which effectively adjusts the resilience of the ring vis-a-vis the other elements. Prior art stepped ring 6 and spring washer 5 have been eliminated by the invention. Such substantial reduction of parts produces such advantages as reduction of manufacturing time and price, reduction of product cost, increased reliability, reduction in maintenance costs, and other advantages which make this a very commercially acceptable product.

The foregoing is descriptive of the principles of the invention. Numerous extensions and modifications thereof would be apparent to the worker skilled in the art. All such extensions and modifications are to be considered to be within the spirit and scope of the invention.

What is claimed is:

1. A grounding connector for grounding a shield of a cable, said grounding connector consisting of a backshell formed with a tapered inner periphery;

a cap nut; and a ring disposed between said cap nut and the tapered periphery of said backshell with the shield being held between said tapered inner periphery and said ring, said ring having means for regulating the distance between said ring and said cap nut when said cap nut is positioned against said regulating means; and wherein said ring is resilient, is formed with a single slit, and is positioned to cause said shield to contact said backshell tapered inner periphery; and wherein said regulating means comprises at least three circumferentially spaced protrusions formed unitarily with said ring and extending toward and engaging said cap nut.

2. The device of claim 1, wherein said cap nut comprises a collar and a stepped portion.

3. The device of claim 1, wherein said ring and said cap nut in combination produce a constant force between said backshell and said ring.

4. The device of claim 1, wherein said cap nut comprises a collar for receiving said at least three protrusions when attached to said ring, and a stepped portion for contacting the end of said backshell.

5. The device of claim 1, wherein said ring comprises four said protrusions.

* * * * *